US007806710B2

(12) United States Patent
Hwang

(10) Patent No.: US 7,806,710 B2
(45) Date of Patent: Oct. 5, 2010

(54) LAMP HOLDING UNIT

(75) Inventor: Kyu-Bok Hwang, Gwangmyeong-si (KR)

(73) Assignee: Samsung Electronics Co., Ltd. (KR)

( * ) Notice: Subject to any disclaimer, the term of this patent is extended or adjusted under 35 U.S.C. 154(b) by 319 days.

(21) Appl. No.: 12/037,678

(22) Filed: Feb. 26, 2008

(65) Prior Publication Data

US 2008/0205085 A1 Aug. 28, 2008

(30) Foreign Application Priority Data

Feb. 27, 2007 (KR) ..... 10-2007-0019777
Feb. 27, 2007 (KR) ..... 10-2007-0019778

(51) Int. Cl.
*H01R 33/02* (2006.01)

(52) U.S. Cl. ..... 439/239

(58) Field of Classification Search ..... 439/226, 439/239, 680, 677, 241, 830, 831
See application file for complete search history.

(56) References Cited

U.S. PATENT DOCUMENTS 3,639,887 A * 2/1972 Johnson et al. ..... 439/239
3,828,299 A * 8/1974 Johnson et al. ..... 439/239
3,854,114 A * 12/1974 Kloth et al. ..... 439/398
6,309,236 B1 * 10/2001 Ullrich ..... 439/226
7,267,567 B1 * 9/2007 Scholeno et al. ..... 439/226
7,347,705 B1 * 3/2008 Huang et al. ..... 439/231
7,553,176 B2 * 6/2009 Naito et al. ..... 439/239
2008/0057763 A1 * 3/2008 Ohmori ..... 439/226

FOREIGN PATENT DOCUMENTS

KR 1020050066019 12/2005
KR 10-2007-0008491 1/2007

* cited by examiner

*Primary Examiner*—T C Patel
*Assistant Examiner*—Phuong Nguyen
(74) *Attorney, Agent, or Firm*—Cantor Colburn LLP

(57) ABSTRACT

A lamp holding unit includes a coupling terminal and a main body. The coupling terminal includes a coupling plate extended in a direction crossing a longitudinal direction of a lamp. The coupling plate has a cutout portion to receive a lead line of the lamp so that the cutout portion of the coupling plate making contact with the lead line. The main body is coupled with the coupling terminal and guiding the lamp. Therefore, an electrical connection between the lamp holding unit and the lead line of the lamp is stabilized, so that noise or spark caused by mal-connection is prevented.

10 Claims, 19 Drawing Sheets

A-A'

B-B'

C

LAMP HOLDING UNIT

CROSS-REFERENCE TO RELATED APPLICATIONS

The present application claims priority under 35 U.S.C. §119 to Korean Patent Application No. 2007-19777, filed on Feb. 27, 2007, and Korean Patent Application No. 2007-19778, filed on Feb. 27, 2007, in the Korean Intellectual Property Office (KIPO), the contents of which are herein incorporated by reference in their entirety.

BACKGROUND OF THE INVENTION

1. Field of the Invention

The present invention relates to a lamp holding unit. More particularly, the present invention relates to a lamp holding unit used for a backlight assembly to decrease defects such as noise or spark caused by mal-connection.

2. Description of the Related Art

A liquid crystal display television (LCD-TV) receiver set, in general, requires high luminance. Thus, the LCD-TV receiver set includes a plurality of fluorescent lamps. For example, an LCD device having a screen size of less than about 37 inches includes an external electrode fluorescent lamp (EEFL), and an LCD device having a screen size of more than about 37 inches includes a cold cathode fluorescent lamp (CCFL).

A lamp holding unit is used for holding the fluorescent lamps, and connects the fluorescent lamps to wires. A conventional lamp holding unit is disclosed in a Korean Patent Application 2005-66019.

FIG. 19 is an exploded perspective view illustrating a conventional lamp holding unit of a related art.

The conventional lamp holding unit 200 holds the lamp using an elastic strength of an inner plate 212 and an outer plate 214. However, the inner and outer plates 212 and 214 are formed by a thin metal plate having a thickness of about 0.15 mm, so that the inner and outer plates 212 and 214 do not have enough elastic strength to securely hold the lamp. Thus, the lamp may be separated from the lamp holding unit 200 by an external impact during or after assembling processes. Also, electric connection between the lamp and the lamp holding unit 200 may be deteriorated.

SUMMARY OF THE INVENTION

The present invention provides a lamp holding unit used for a backlight assembly to decrease defects such as noise or spark caused by mal-connection.

A lamp holding unit in accordance with an embodiment of the present invention includes a coupling terminal and a main body. The coupling terminal includes a coupling plate extended in a direction crossing a longitudinal direction of a lamp. The coupling plate has a cutout portion to receive a lead line of the lamp so that the cutout portion of the coupling plate making contact with the lead line. The main body is coupled with the coupling terminal and guiding the lamp.

The lamp holding unit may further include a securing part connected to the main body to press a side of the coupling terminal, so that the lead line is securely combined with the coupling terminal.

The coupling terminal may further include two horizontal plates spaced apart from each other and extended in the longitudinal direction, two coupling plates extended from the horizontal plates, respectively, and a connecting plate that connects upper surfaces of the coupling plates. A slit may be formed through the connecting plate to guide the lead line.

The coupling plates and the connecting plate may form a U-shape when viewed from a side of the lamp holding unit.

A cutting slit may be formed through the coupling plate under the lead line.

A lamp holding unit in accordance another embodiment of the present invention includes a coupling terminal, a main body and a securing part. The coupling terminal includes a coupling plate extended in a direction crossing a longitudinal direction of a lamp. The coupling plate has a cutout portion to receive a lead line of the lamp so that the coupling plate making contact with the lead line. The main body is coupled with the coupling terminal and guiding the lamp. The securing part is connected to the main body, so that the lead line is securely combined with the coupling terminal.

The securing part may press a side of the coupling terminal.

The coupling plate may include a compressing portion that has a stepwise shape.

The securing part may press the lead line from an upper portion of the cutout portion.

A lamp holding unit in accordance with still another aspect of the present invention includes a coupling terminal and a main body. The coupling terminal includes a plurality of coupling plates extended in a direction crossing a longitudinal direction of a lamp, and a connecting plate that connects the coupling plates. Each of the coupling plates has a cutout portion to receive a lead line of the lamp so that the cutout portions of the coupling plates making contact with the lead line. The coupling plates and the connecting plate form a U-shape when viewed from a side of the lamp holding unit. The main body is coupled with the coupling terminal and guiding the lamp.

The coupling terminal may further include a plurality of horizontal plates connected to the coupling plates, respectively.

The connecting plate connects upper surfaces of the coupling plates, and a slit is formed through the connecting plate to guide the lead line.

A lamp holding unit in accordance with further still another aspect of the present invention includes a conductive base and a cover. The conductive base includes a base plate including metal, and a plurality of coupling terminals protruded from the base plate. The coupling terminals are spaced apart from each other. A cutout portion is formed through an upper portion of each of the coupling terminals. A lead line of a lamp is received in the coupling portion so that the lead line is electrically connected to the conductive base. The cover is received on the conductive base. A throughhole is formed through the cover corresponding to each of the coupling terminals to guide the lead line.

Sides of the base plate may be folded to form U-shape with respect to a longitudinal direction of the lamp, and the coupling terminals may be integrally formed with the base plate.

A plurality of holes may be spaced apart from each other is formed through the folded side of the base plate.

An upper corner of each of the coupling terminals may be chamfered.

A cutting slit may be formed through each of the coupling terminals under the lead line.

The cover may include an upper plate having an extended shape, a first side plate bent toward a lower portion of the lamp holding unit and having the throughhole, and a second side plate bent toward the lower portion of the lamp holding unit.

The cover may include a synthetic resin.

The cover may further have a plurality of compressing portions that surround the chamfered corners of the coupling terminals and press the chamfered corners.

The cover may further include a partition wall interposed between adjacent compressing portions, and the partition wall is integrally formed with the upper plate.

A plurality of protrusions may be formed on the first and second side plates corresponding to the holes of the base plate, and the protrusions may be received in the holes of the base plate.

BRIEF DESCRIPTION OF THE DRAWINGS

The above and other advantages of the present invention will become more apparent by describing in detail example embodiments thereof with reference to the accompanying drawings, in which.

DESCRIPTION OF THE EMBODIMENTS

Figure 1:
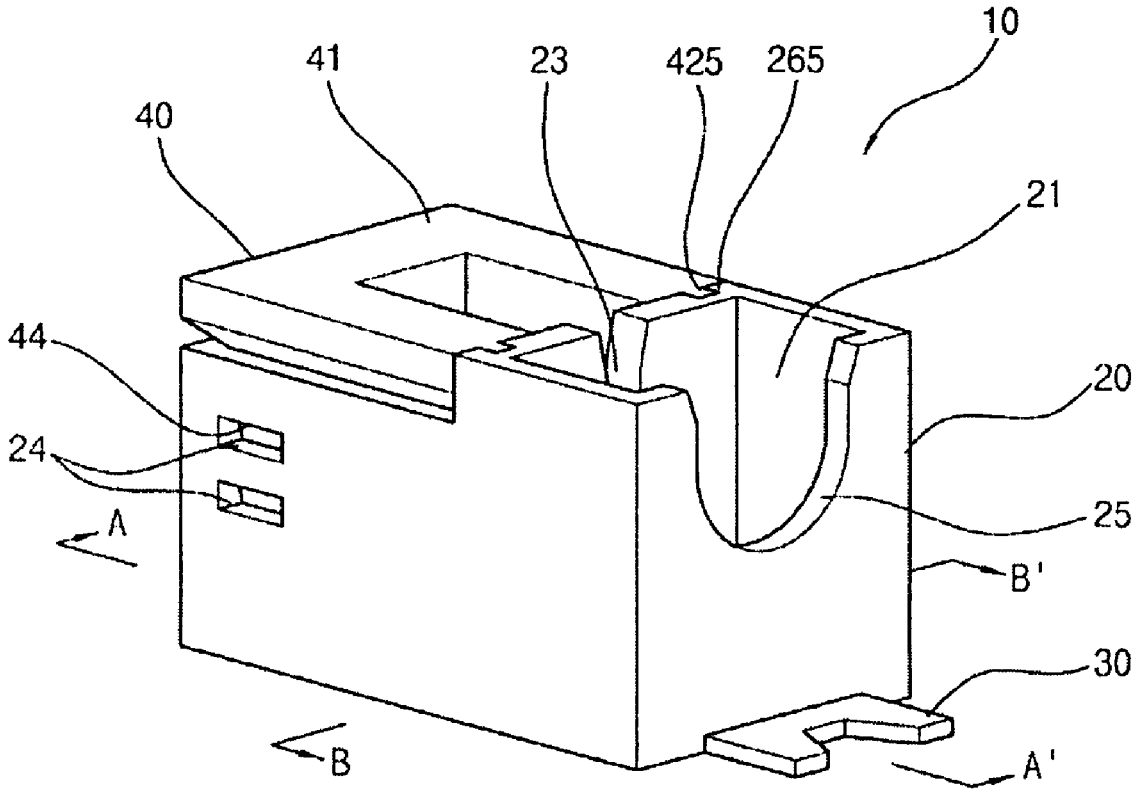
FIG. 1 is a perspective view illustrating a lamp holding unit in accordance with one embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

Figure 2:
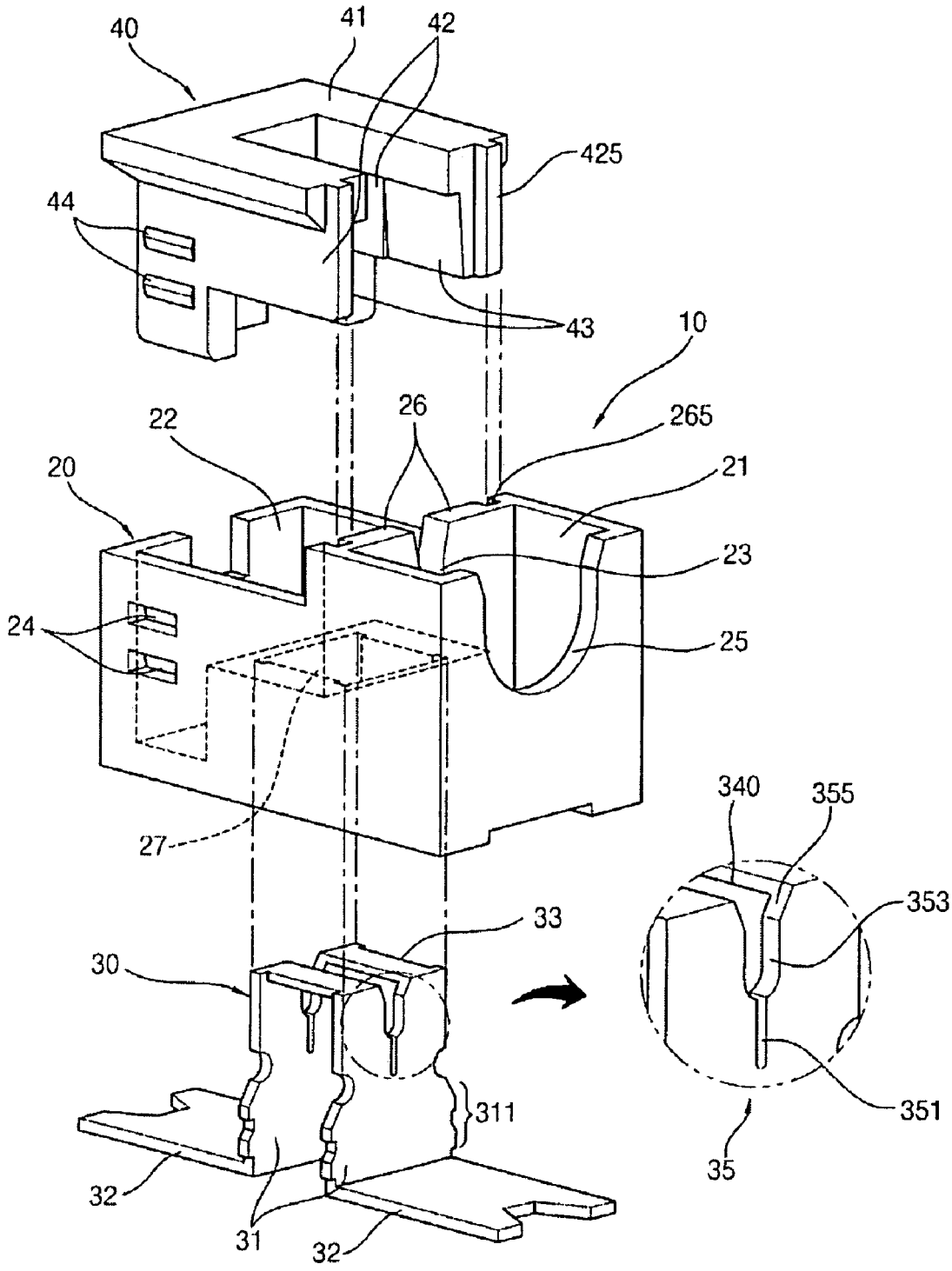
FIG. 2 is an exploded perspective view illustrating the lamp holding unit shown in FIG. 1.

FIG. 1 is a perspective view illustrating a lamp holding unit in accordance with one embodiment of the present invention. FIG. 2 is an exploded perspective view illustrating the lamp holding unit shown in FIG. 1.

Referring to FIGS. 1 and 2, the lamp holding unit 10 includes a main body 20, a coupling terminal 30 and a securing part 40. The main body 20 connects the coupling terminal 30 to a lead line 110 of a fluorescent lamp 100. The main body 20 has a box shape, and an upper portion of the main body 20 is opened. A throughhole 27 is formed through the main body 20 to receive the coupling terminal 30 in the throughhole 27. A lamp supporting hole 25 is formed on a side of the main body 20 to support the fluorescent lamp 100.

In FIGS. 1 and 2, a first divided space 21 and a second divided space 22 are formed in the main body 20 by a partition wall 26. The lamp supporting hole 25 for supporting the fluorescent lamp 100 is formed on a side of the first divided space 21, and a lead supporting hole 23 is formed on an upper portion of the partition wall 26 to support the lead line 110 of the fluorescent lamp 100.

The throughhole 27 is formed in the second divided space 22 adjacent to the partition wall 26 to receive the coupling terminal 30. A hole 24 is formed adjacent to the second divided space 22 to receive a protrusion 44 of the cap 40. Also, a guiding groove 265 is formed on the partition wall 26 in the second divided space 22 along a vertical direction.

A compressing portion 43 is formed on an inner surface in the second divided space 22 of the main body 20 to presses two sides of a connecting plate 33 of the coupling terminal 30 which is disposed under the compressing portion 43.

For example, a metal plate is bent to form the coupling terminal 30 having a horizontal plate 32, a coupling plate 31 and the connecting plate 33. The connecting plate 33 has a plate shape. For example, two coupling plates 31 are bent from two sides of the connecting plate 33 toward a lower portion of the lamp holding unit 10. The horizontal plate 32 is protruded from a lower side of the coupling plate 31 toward an exterior to the coupling terminal 30.

A cutout portion 35 is formed on an upper portion of the coupling plate 31 connected to the connecting plate 33. The lead line 110 of the fluorescent lamp 100 is received in the cutout portion 35. A slit 340 is formed through the connecting plate 33 to connect the cutout portions 35 through the slit 340, so that the lead line 110 of the fluorescent lamp 100 is received in cutout holes 353 of the cutout portion 35. An upper portion of the cutout portion 35 has a guiding surface 355 that is inclined with respect to the vertical direction, so that the lead line 110 may be easily received in the cutout hole 353.

A cutting slit 351 is formed through the coupling plate 33 under the lead line 110 so that the coupling plate 33 may have elasticity. An end portion of the cutting slit 351 has a rounded shaped to dissipate a stress applied to the end portion of the cutting slit 351.

Figure 3:
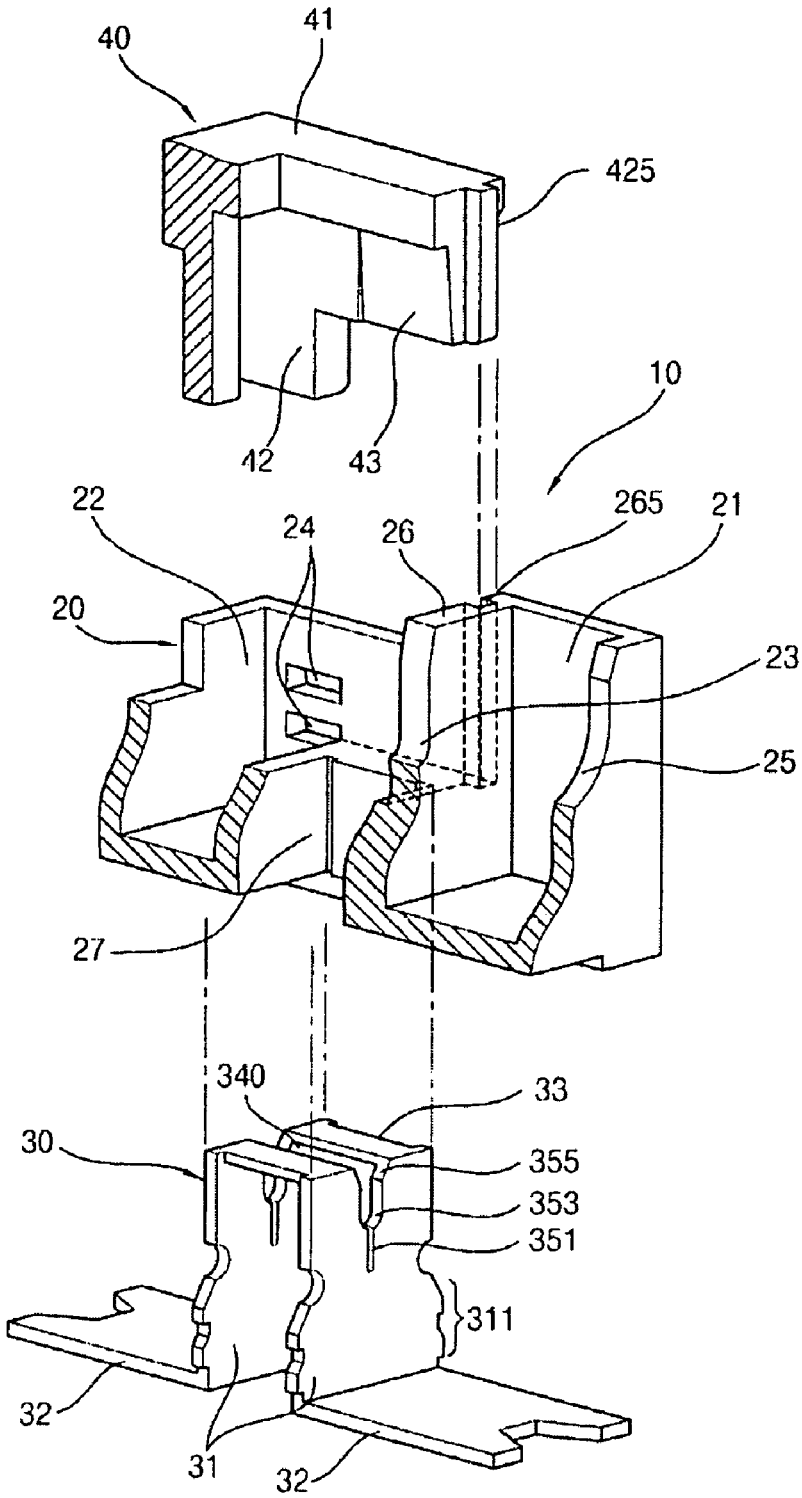
FIG. 3 is a partially cutout perspective view illustrating the lamp holding unit shown in FIG. 1.

FIG. 3 is a partially cutout perspective view illustrating the lamp holding unit shown in FIG. 1.

The coupling plate 31 has a compressing portion 311 on a lower portion of the coupling plate 31. In FIG. 3, the compressing portion 311 has a stepwise shape inclined toward a lower portion of the lamp holding unit 10, so that the compressing portion 311 having the stepwise shape may be hooked with the main body 20.

The securing part 40 includes an upper plate 41 having U shape and a side plate 42 extended from the lower surface of the upper plate 41. A protrusion 44 is formed on an outer surface of the side plate 42 to be received in the hole 24 of the main body 20.

A compressing portion 43 is formed in the side plate 42 of the securing part 40 to press the connecting plate 33 of the coupling terminal 30 which is received in the main body 20, thereby fixing the coupling terminal 30 to the lead line 110 of the fluorescent lamp 100. In FIG. 3, a guiding protrusion 425 is formed on the side plate 42 and the upper plate 41 to slide into the guiding groove 265.

Figure 4:
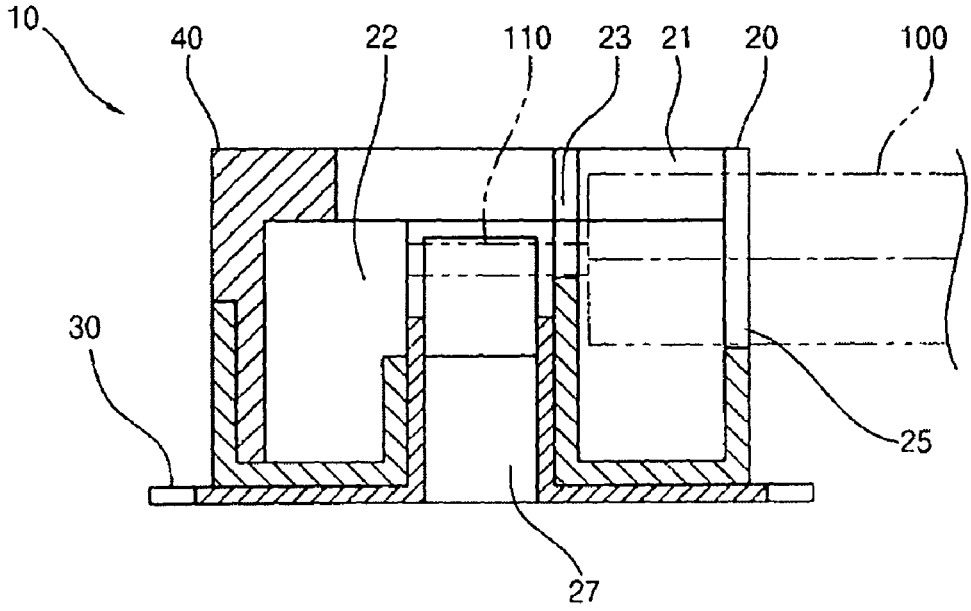
FIG. 4 is a cross-sectional view taken along a line A-A' shown in FIG. 1.
Figure 5:
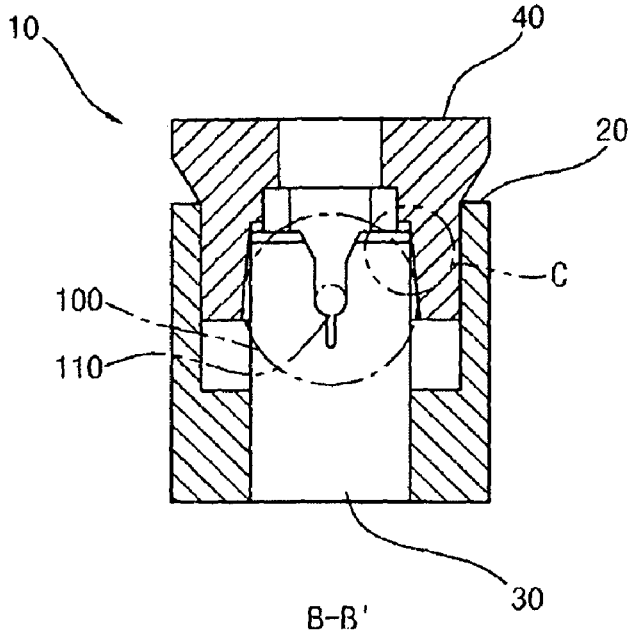
FIG. 5 is a cross-sectional view taken along a line B-B' shown in FIG. 1.
Figure 6:
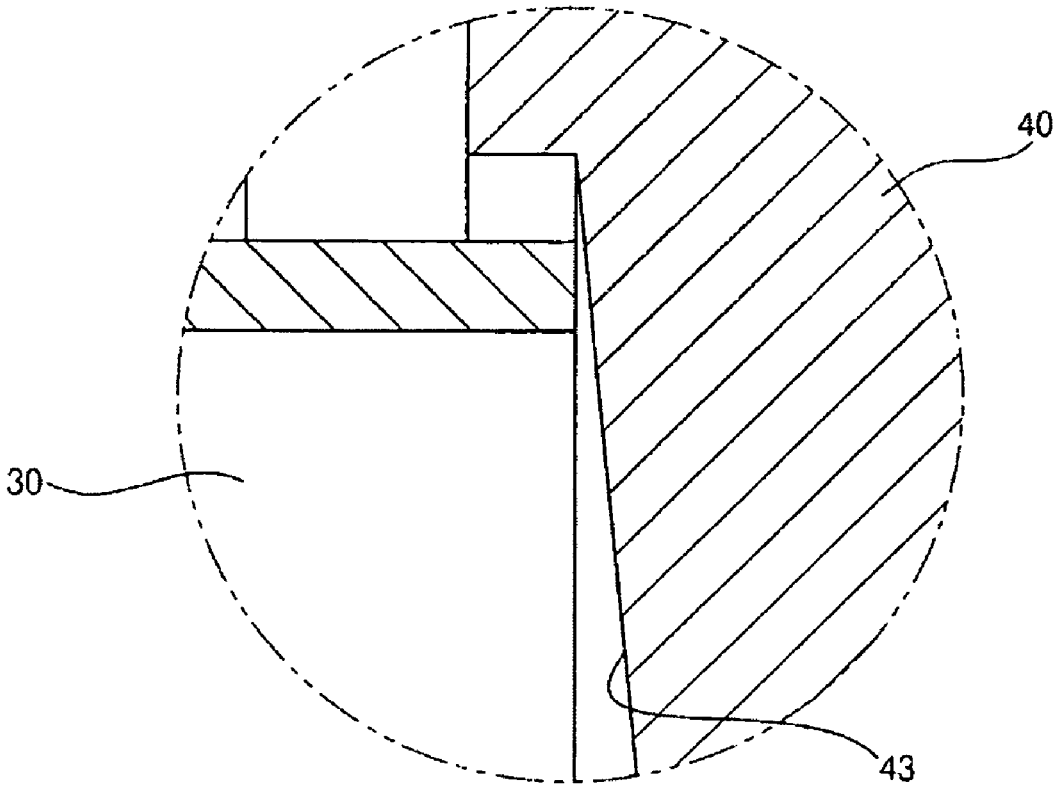
FIG. 6 is an enlarged cross-sectional view illustrating the lamp holding unit shown in FIG. 5.

FIG. 4 is a cross-sectional view taken along a line A-A' shown in FIG. 1. FIG. 5 is a cross-sectional view taken along a line B-B' shown in FIG. 1. FIG. 6 is an enlarged cross-sectional view illustrating the lamp holding unit shown in FIG. 5.

Figure 7:
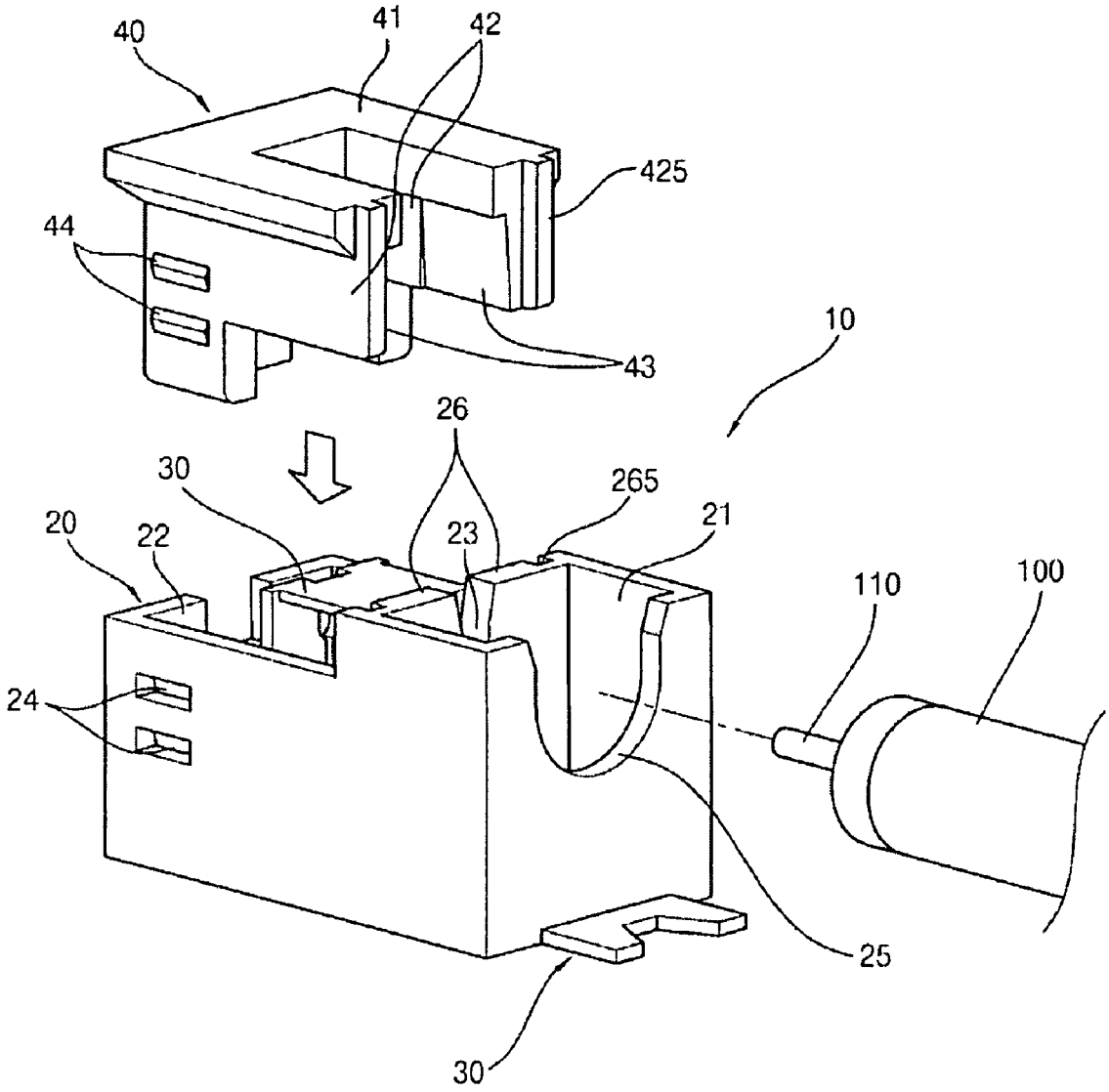
FIGS. 7 and 8 are perspective views illustrating a method of assembling a backlight assembly having the lamp holding unit shown in FIG. 1.
Figure 8:
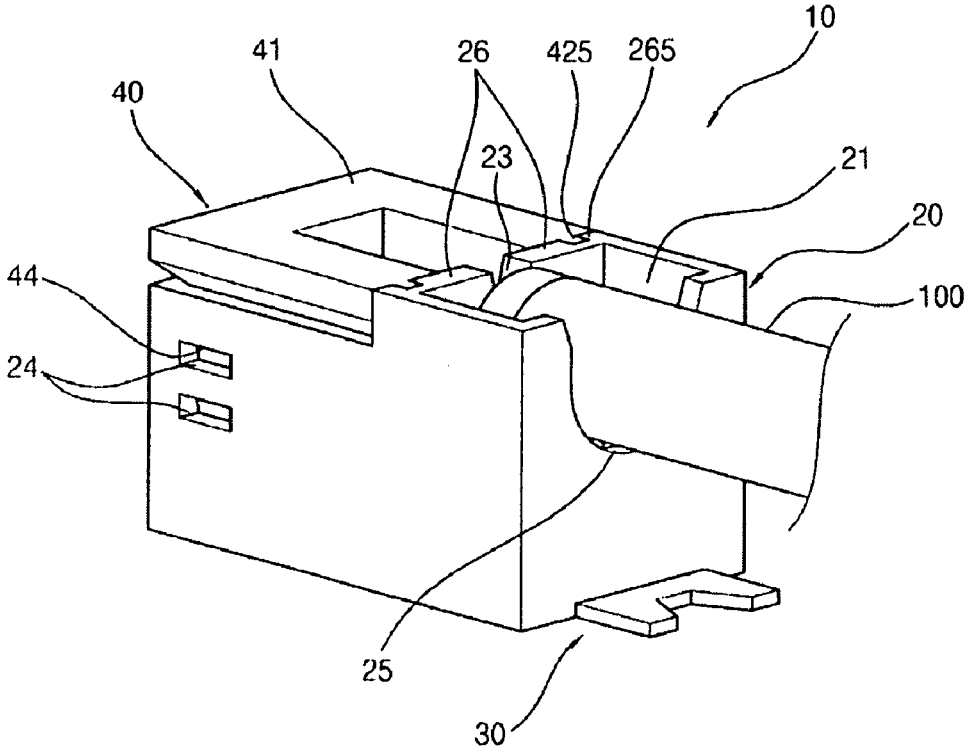

FIGS. 7 and 8 are perspective views illustrating a method of assembling a backlight assembly having the lamp holding unit shown in FIG. 1.

Referring to FIGS. 1, 2, 3, 7 and 8, the coupling terminal 30 is inserted into the main body 20 from a lower portion of the main body 20. The compressing portion 311 formed in the coupling terminal 30 is inserted into the throughhole 27 of the second divided space 22, so that the stepwise portion of the compressing portion 311 is fitted to an inner surface of the throughhole 27. The fluorescent lamp 100 is received on the lamp supporting hole 25 of the main body 20, and the lead line 110 is received in the cutout portion 35 of the coupling terminal 30.

FIG. 4 is a cross-sectional view taken along a line A-A' shown in FIG. 1. FIG. 5 is a cross-sectional view taken along a line B-B' shown in FIG. 1. FIG. 6 is an enlarged cross-sectional view illustrating the lamp holding unit shown in FIG. 5.

Referring to FIGS. 1-8, the cap 40 is received in the second divided space 22 of the main body 20 toward the lower portion of the lamp holding unit 10, and the guiding protrusion 425 is received in the guiding hole 265. Also, the protrusion 44 formed on the outer surface of the side plate 42 is received in the hole 24 of the main body 20. In FIGS. 5 and 6, the compressing surface 43 of the cap 40 presses the sides of the connecting plate 33 of the coupling terminal 30, so that the lead line 110 is securely combined with the cutout portion 353.

Figure 9:
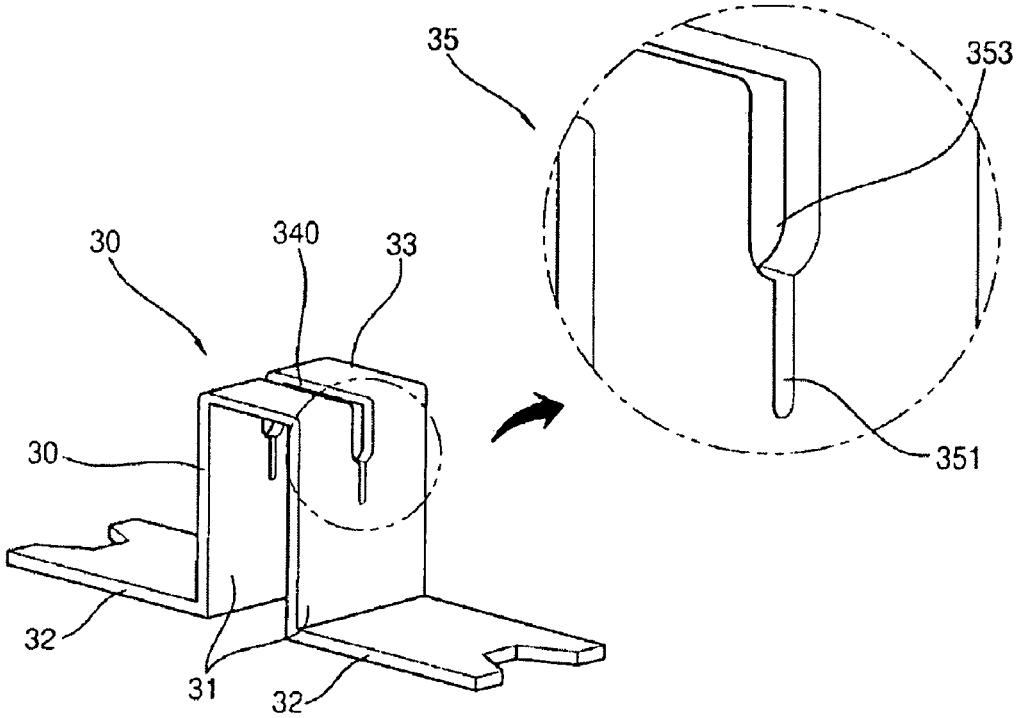
FIG. 9 is a perspective view illustrating a coupling terminal in accordance with another embodiment of the present invention.

FIG. 9 is a perspective view illustrating a coupling terminal in accordance with another embodiment of the present invention. The lamp holding unit of FIG. 9 is same as in FIGS. 1 to 8 except a coupling terminal. Thus, the same reference numerals will be used to refer to the same or like parts as those described in FIGS. 1 to 8 and any further explanation concerning the above elements will be omitted.

Referring to FIG. 9, the cutout portion 35 of the coupling terminal 30 includes a cutting slit 351 and a cutout hole 353.

The cutout hole 353 is extended in a vertical direction of the lamp holding unit. For example, the compressing portion may be omitted.

Figure 10:
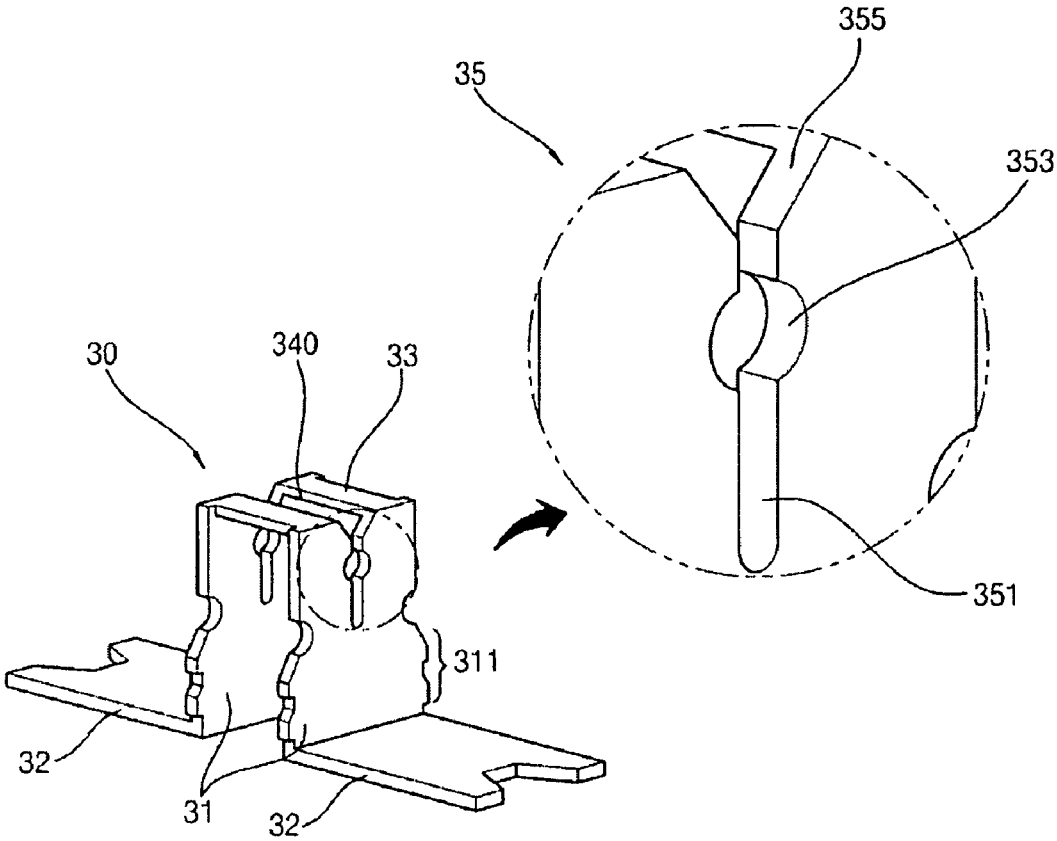
FIG. 10 is a perspective view illustrating a coupling terminal in accordance with still another embodiment of the present invention.

FIG. 10 is a perspective view illustrating a coupling terminal in accordance with still another embodiment of the present invention. The lamp holding unit of FIG. 10 is same as in FIGS. 1 to 8 except a cutout portion. Thus, the same reference numerals will be used to refer to the same or like parts as those described in FIGS. 1 to 8 and any further explanation concerning the above elements will be omitted.

Referring to FIG. 10, the cutout portion 35 includes a cutting slit 351, a contacting hole 353 and a guiding surface 355. The contacting hole 353 is spaced apart from the guiding surface 355.

Figure 11:
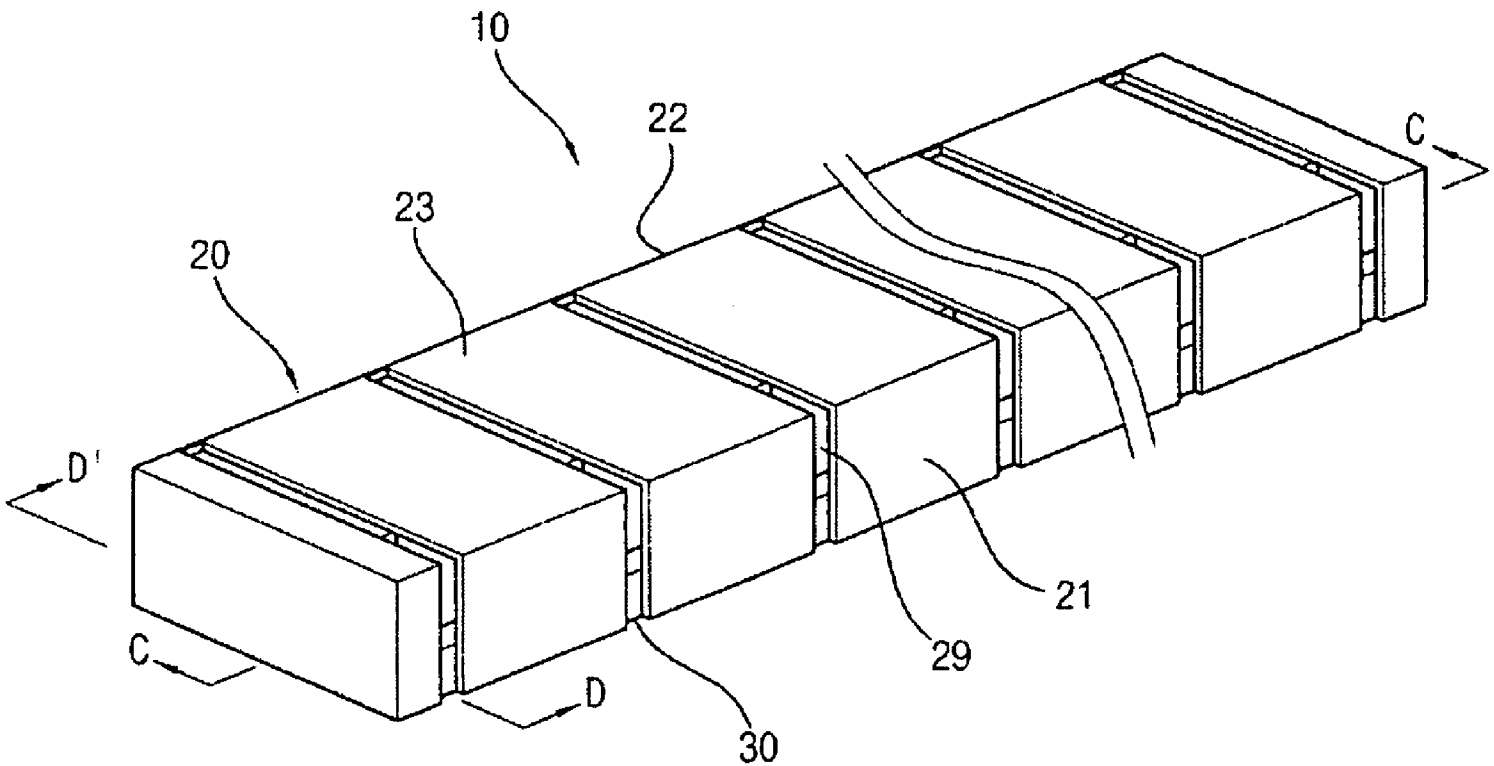
FIG. 11 is a perspective view illustrating a lamp holding unit in accordance with further still another embodiment of the present invention.
Figure 12:
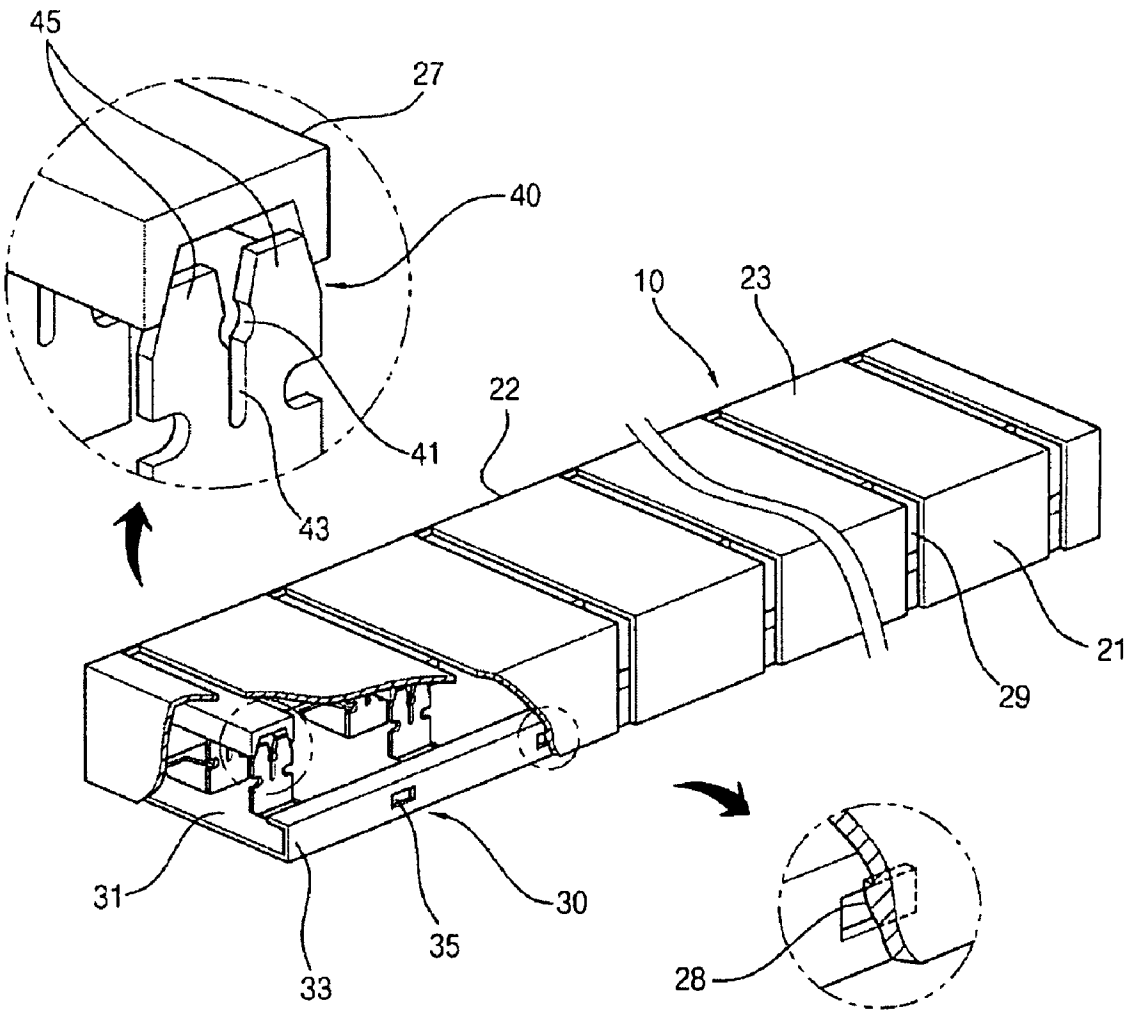
FIG. 12 is a partially cutout perspective view illustrating the lamp holding unit shown in FIG. 11.

FIG. 11 is a perspective view illustrating a lamp holding unit in accordance with further still another embodiment of the present invention. FIG. 12 is a partially cutout perspective view illustrating the lamp holding unit shown in FIG. 11.

Referring to FIGS. 11 and 12, the lamp holding unit 10 includes a conductive base 30 and a cover 20.

Figure 13:
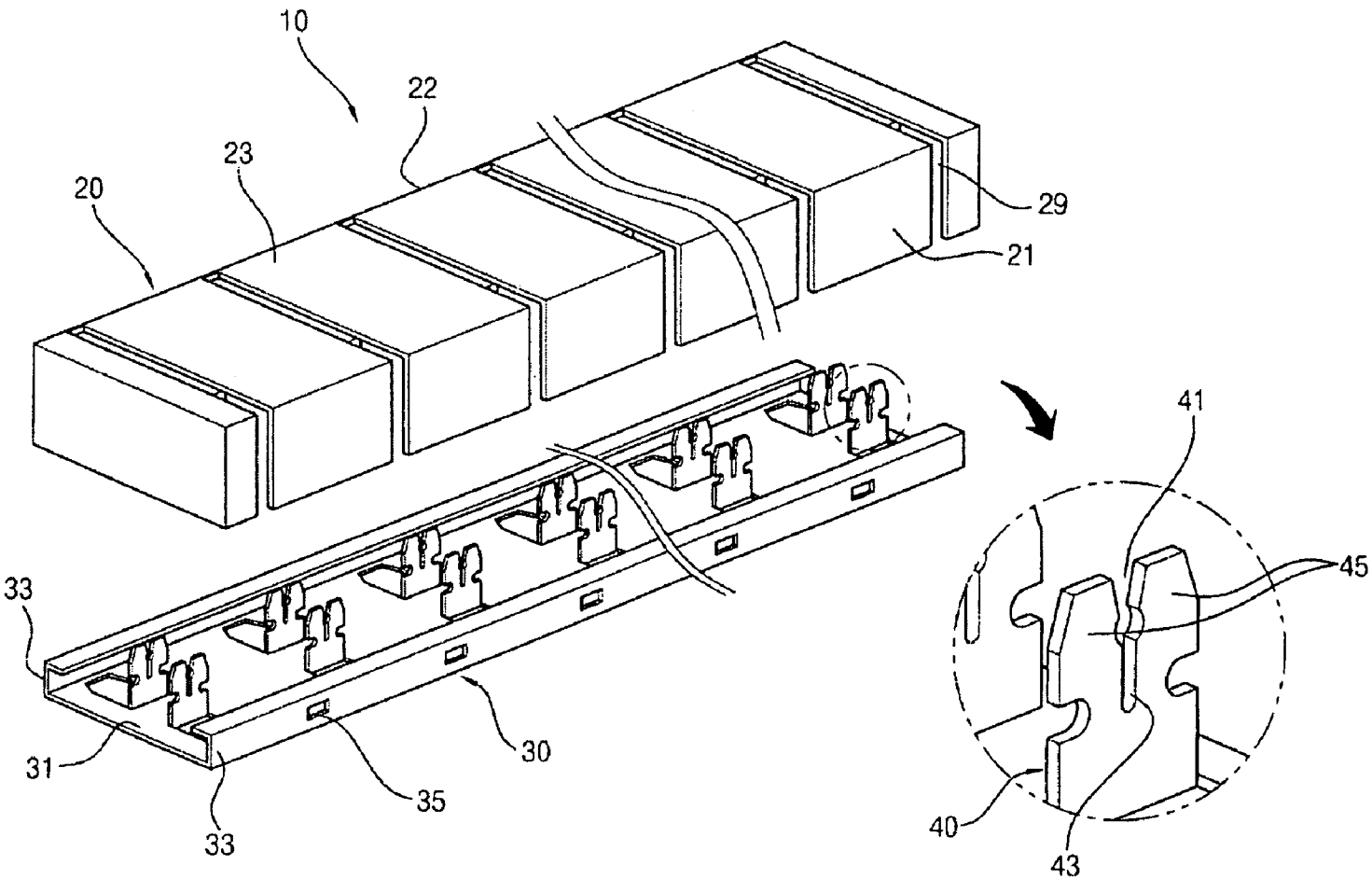
FIG. 13 is an exploded perspective view illustrating the lamp holding unit shown in FIG. 11.

FIG. 13 is an exploded perspective view illustrating the lamp holding unit shown in FIG. 11.

Referring to FIGS. 11 to 13, the conductive base 30 may be formed by cutting a metal plate and bending the cutted metal plate. In FIG. 13, the metal plate is bent to form two side frames 33 and a base plate 31, so that the conductive base 30 has a U-shape. A plurality of holes 35 is formed through the side frames 33. A plurality of protrusions 28 of the cover 20 is received in the holes 35 of the conductive base 30.

For example, two coupling terminals 40 are spaced apart from each other on the base plate 31. The coupling terminals 40 may be formed by bending a portion of the base plate 31. Alternatively, the coupling terminals 40 may be attached to the base plate 31 by welding, soldering, etc.

In FIG. 13, the coupling terminal 40 includes two chamfered surfaces 45, and a cutout portion 41 is formed on an upper portion of the coupling terminal 40 between the chamfered surfaces 45. A cutting slit 43 is formed under the cutout portion 41. A lead line 110 of a fluorescent lamp 100 is received in the cutout portion 41. The chamfered surfaces 45 are inclined with respect to a vertical direction of the lamp holding unit so that the chamfered surfaces 45 may be pressed toward a center of the coupling terminal 40 by compression of a compressing portion 27.

The cover 20 received on the conductive base 30 may include a synthetic resin. The cover 20 includes an upper plate 23 having an extended shape, a first side plate 21 bent toward a lower portion of the lamp holding unit 10 and having the throughhole, and a second side plate 22 bent toward the lower portion of the lamp holding unit 10.

Figure 14:
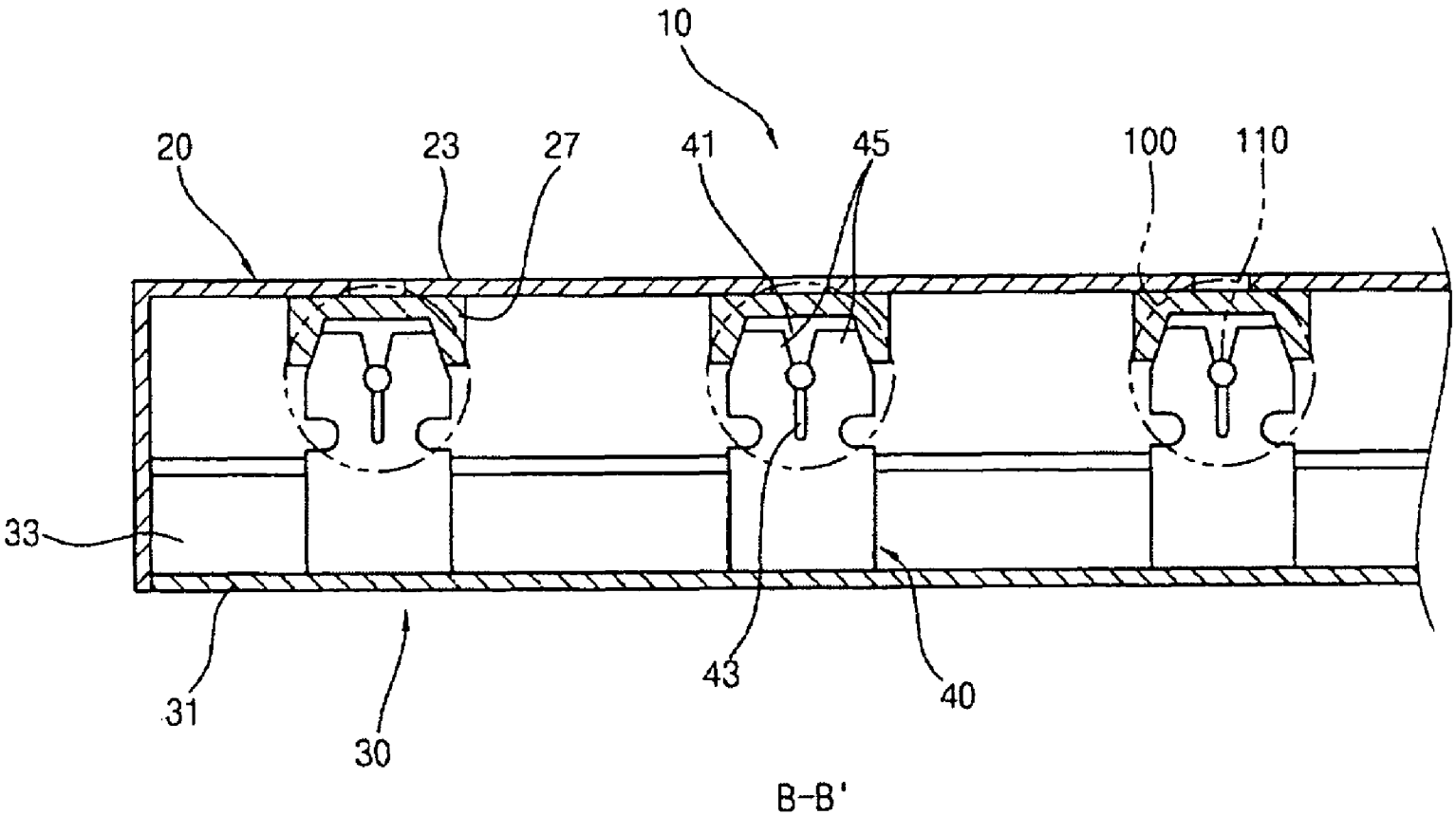
FIG. 14 is a cross-sectional view taken along a line C-C' shown in FIG. 11.
Figure 15:
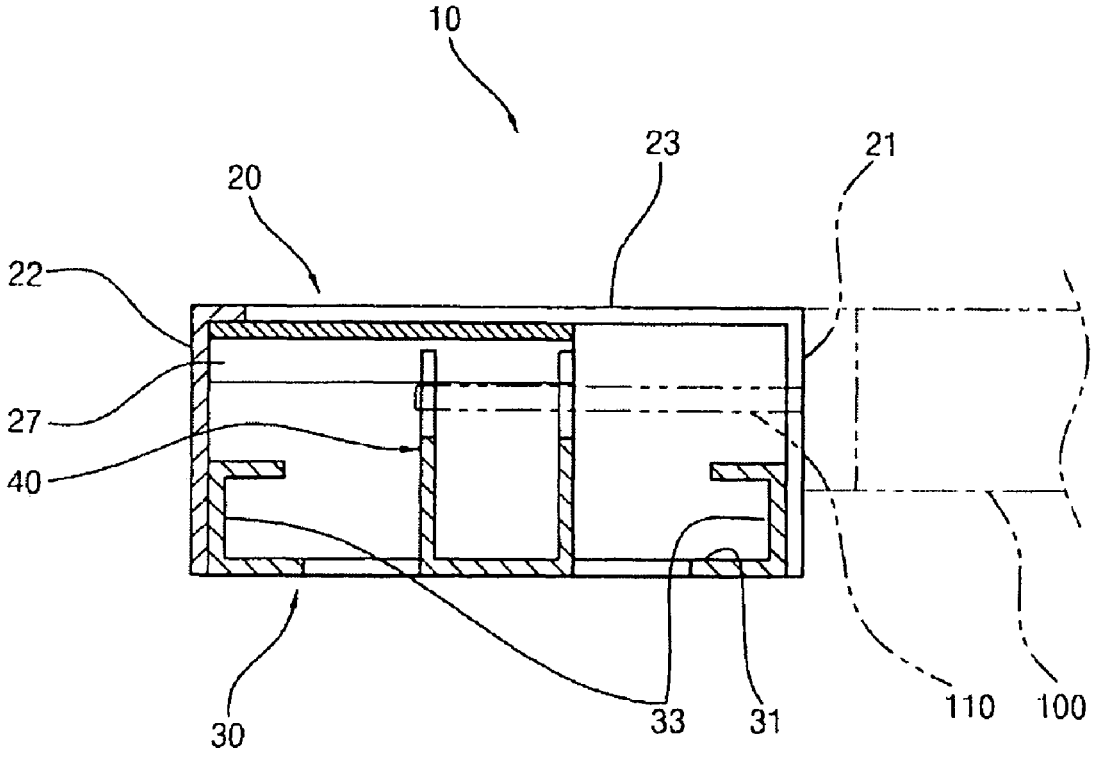
FIG. 15 is a cross-sectional view taken along a line D-D' shown in FIG. 11.

FIG. 14 is a cross-sectional view taken along a line C-C' shown in FIG. 11. FIG. 15 is a cross-sectional view taken along a line D-D' shown in FIG. 11.

Referring to FIGS. 11 to 15, a plurality of throughholes 29 is formed through the first side plate 21. The lead line 110 of the fluorescent lamp 100 passes through the throughhole 29, and is received in the cutout portion 41 of the coupling terminal 40. Thus, a distance between adjacent throughholes 29 is substantially the same as a distance between adjacent coupling terminals 40. For example, the throughhole 29 may be extended from the first side plate 21 toward the upper plate 23.

A compressing portion 27 may be formed on the upper plate 23 of the cover 20. The compressing portion 27 has U-shaped cross-section, and an inner surface of the compressing portion 27 is inclined with respect to the vertical direction of the lamp holding unit 10. The compressing portion 27 presses the chamfered surface 43 of the coupling terminal 40, so that the chamfered surface 43 of the coupling terminal 40 is pressed toward a center of the coupling terminal 40. Thus, the lead line 110 of the fluorescent lamp 100 is securely combined with the cutout portion 41.

In FIG. 12, the protrusions 28 are formed on inner surfaces of the first and second side plates 21 and 22 of the cover 20, and are received in the holes 35 formed through the side frame 33 of the conductive base 30. Thus, the cover 20 is combined with the conductive base 30.

Figure 16A:
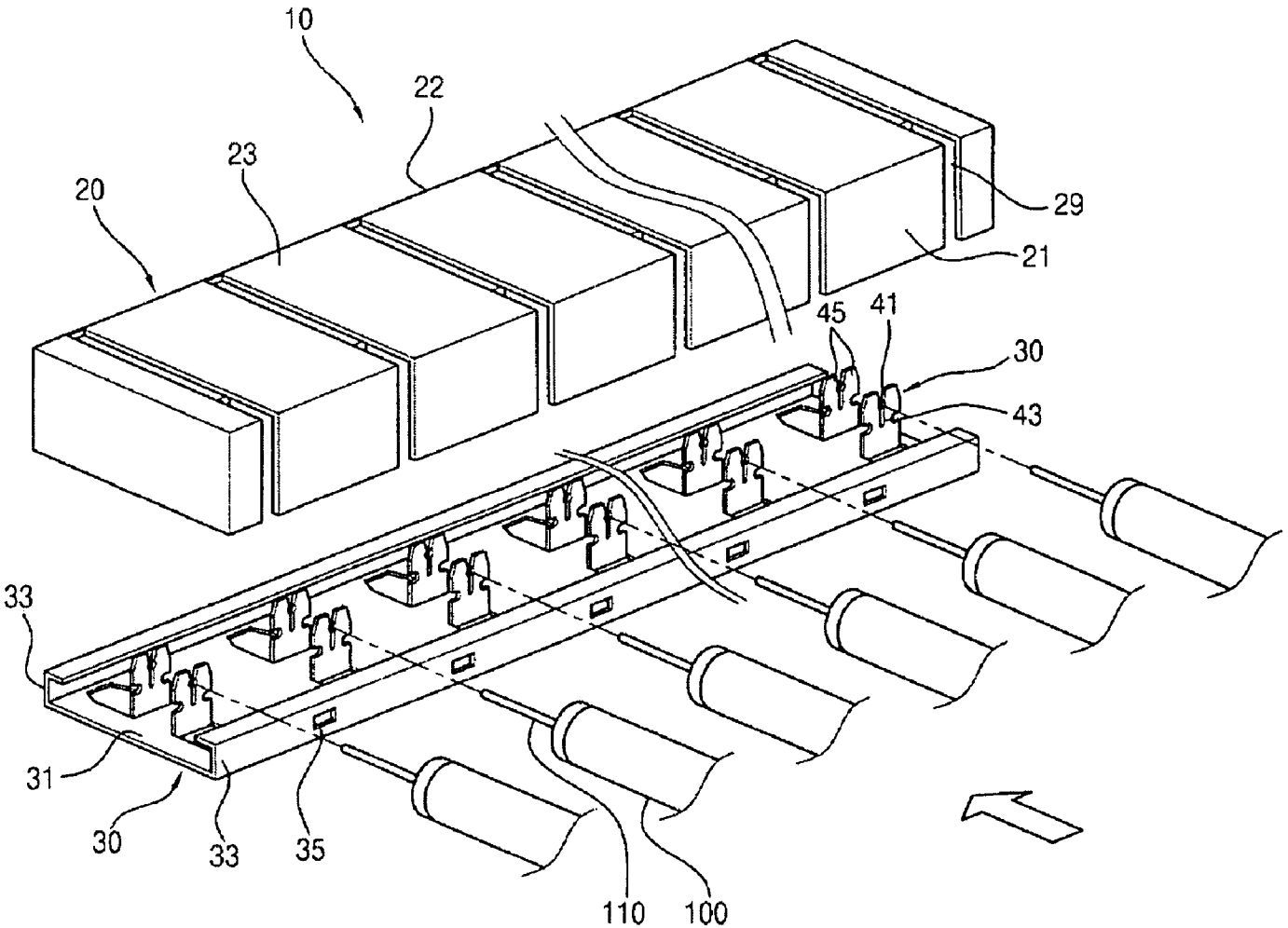
FIGS. 16A to 16C are perspective views illustrating a method of assembling a backlight assembly having the lamp holding unit shown in FIG. 11.
Figure 16B:
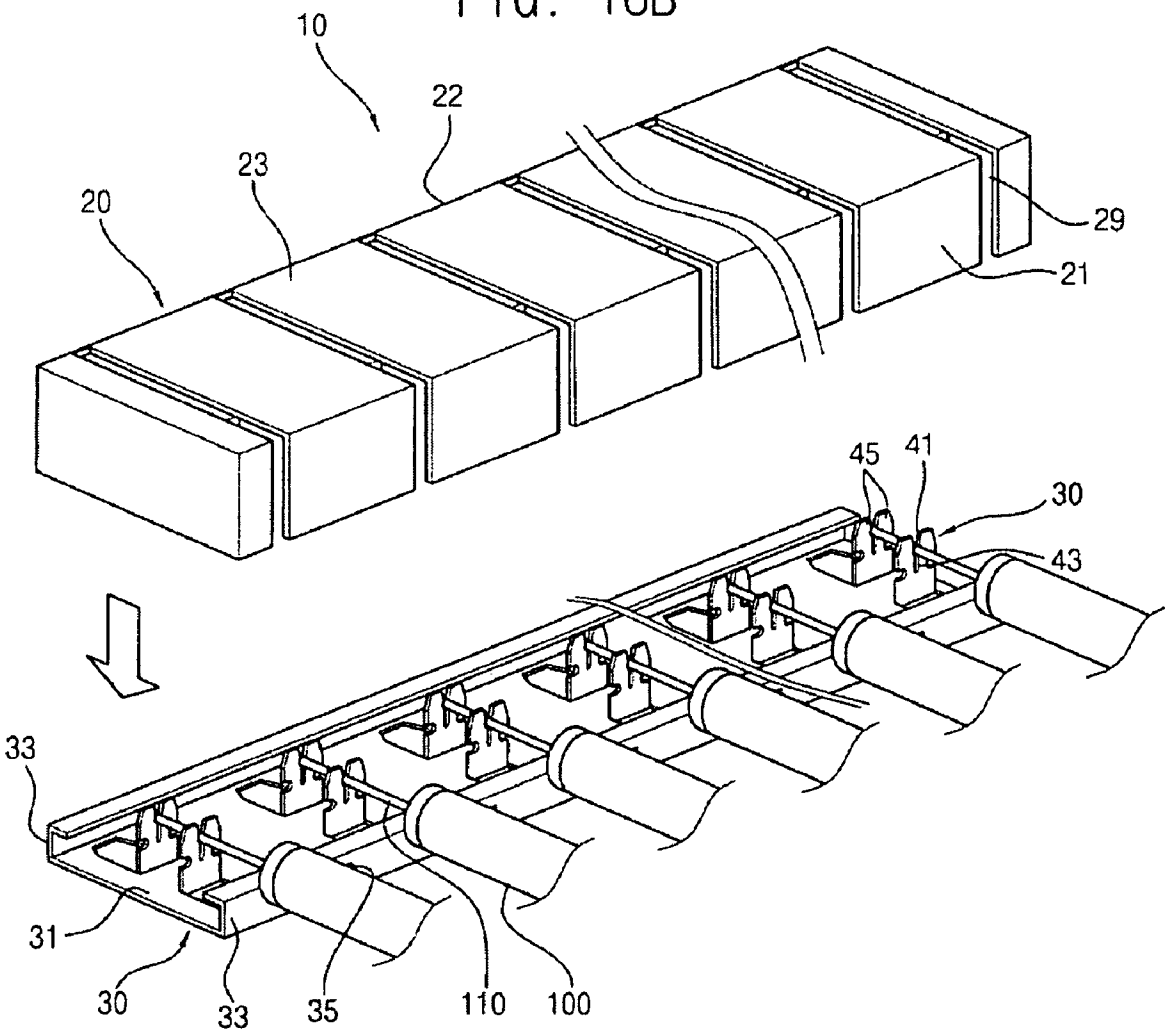
Figure 16C:
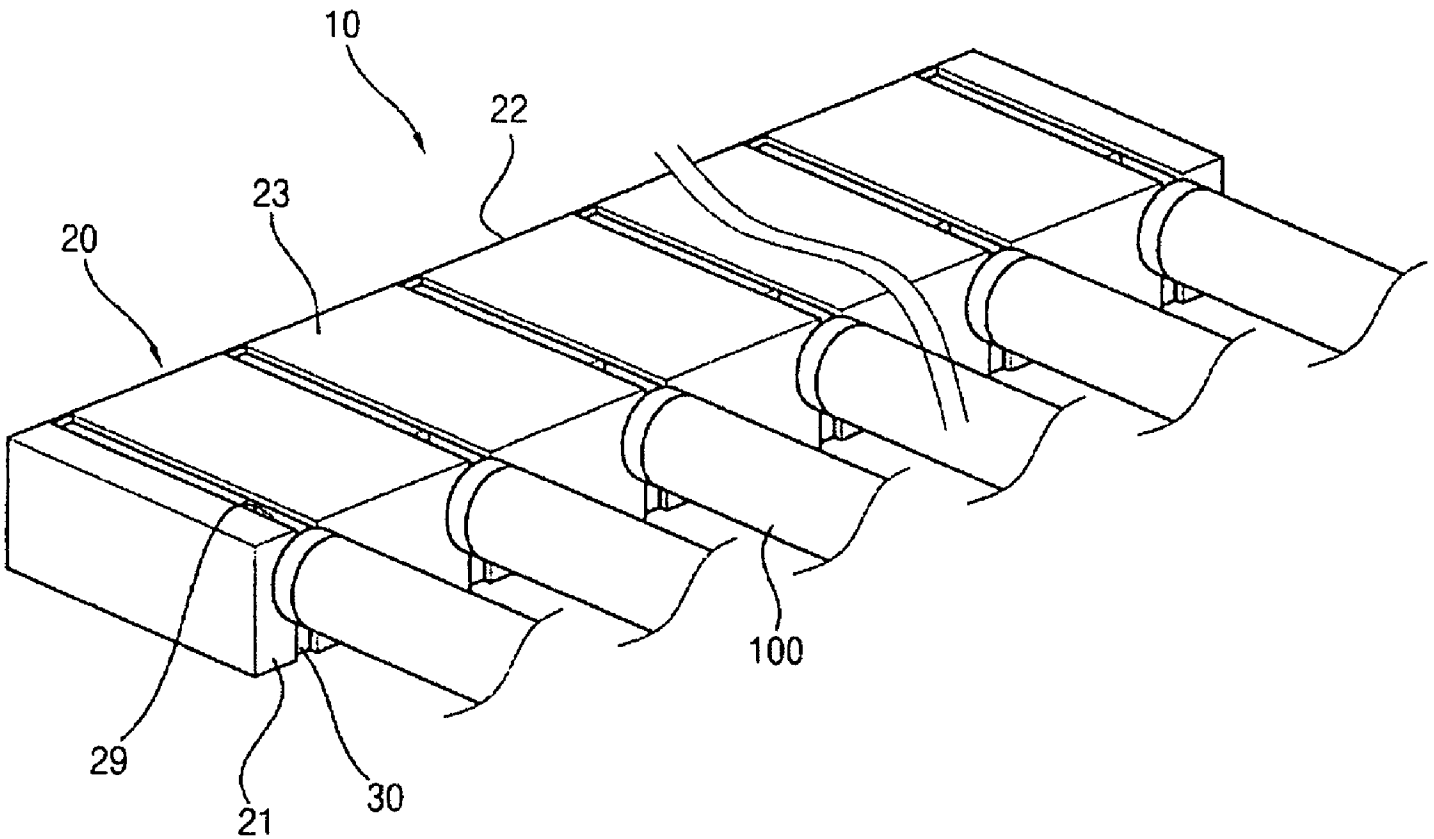

FIGS. 16A to 16C are perspective views illustrating a method of assembling a backlight assembly having the lamp holding unit shown in FIG. 11.

Referring to FIG. 16A, while the cover 2 is separated from the conductive base 30, the lead line 110 of the fluorescent lamp 100 is received in two coupling terminals 40.

Referring to FIG. 16B, after the lead line 110 of the fluorescent lamp 100 is received in the cutout portion 41 of the coupling terminal 40, the cover 20 is pressed toward the conductive base 30. The protrusions 28 formed on the inner surfaces of the first and second side plates 21 and 22 are received in the holes 35 formed through the side frames 33, so that the cover 20 is combined with the conductive base 30. The lead line 110 is securely combined with the cutout portion 29.

Referring to FIG. 16C, the chamfered surfaces 45 of the coupling terminal 40 are compressed toward the center of the coupling terminal 40 by the compressing portions 27, so that the lead line 110 is securely combined with the cutout portion 41.

Figure 17:
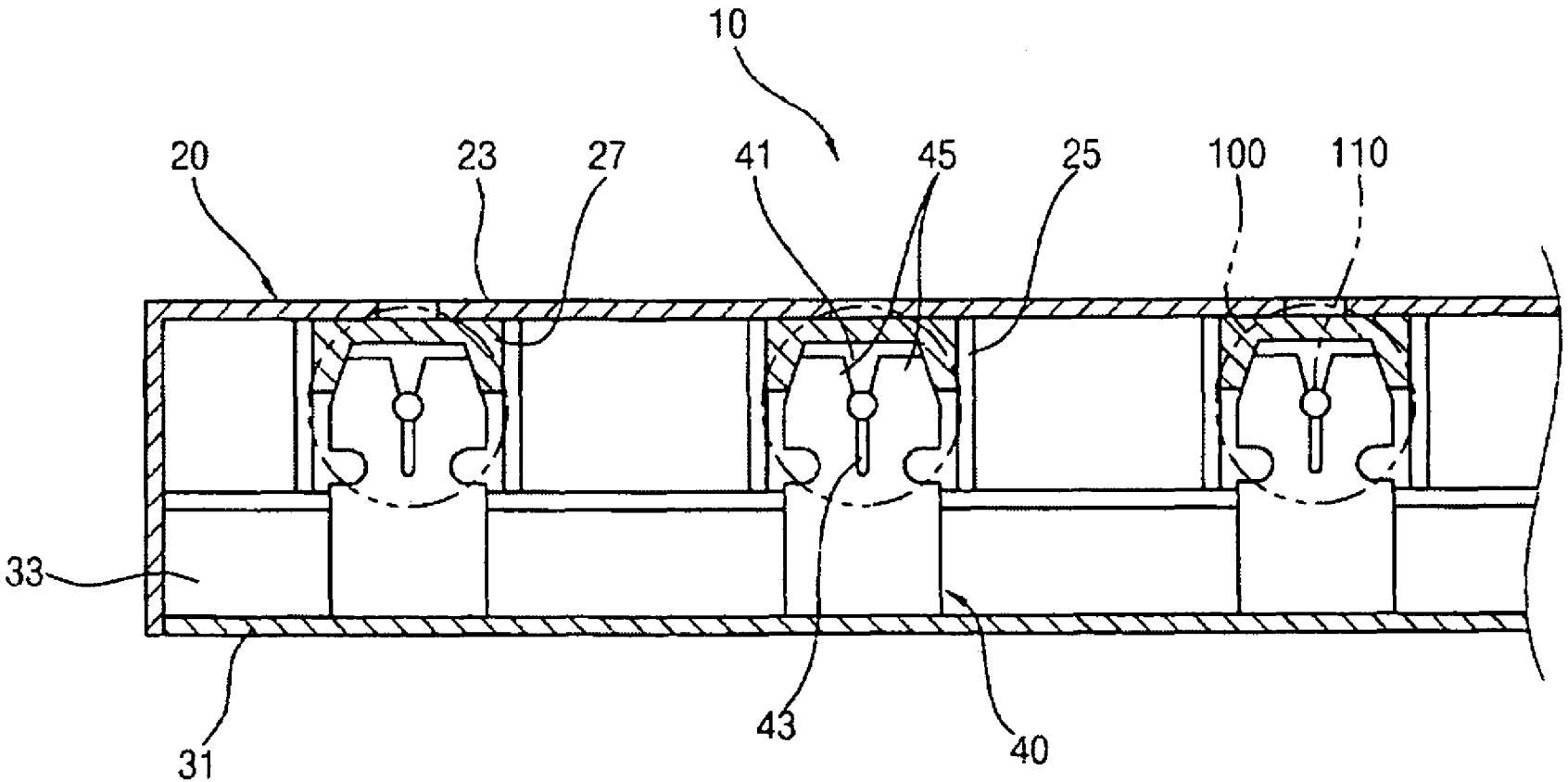
FIG. 17 is a cross-sectional view illustrating a lamp holding unit in accordance with further still another embodiment of the present invention.

FIG. 17 is a cross-sectional view illustrating a lamp holding unit in accordance with further still another embodiment of the present invention. The lamp holding unit of FIG. 17 is same as in FIGS. 11 to 15 except a partition wall. Thus, the same reference numerals will be used to refer to the same or like parts as those described in FIGS. 1 to 8 and any further explanation concerning the above elements will be omitted.

Referring to FIG. 17, two partition walls 25 are formed on sides of compressing portions 27. The partition walls 25 may be formed through molding with the upper plate 23. The partition walls 25 may be combined with an upper surface of side frames 33 of a conductive base 30 to support the cover 20.

Figure 18:
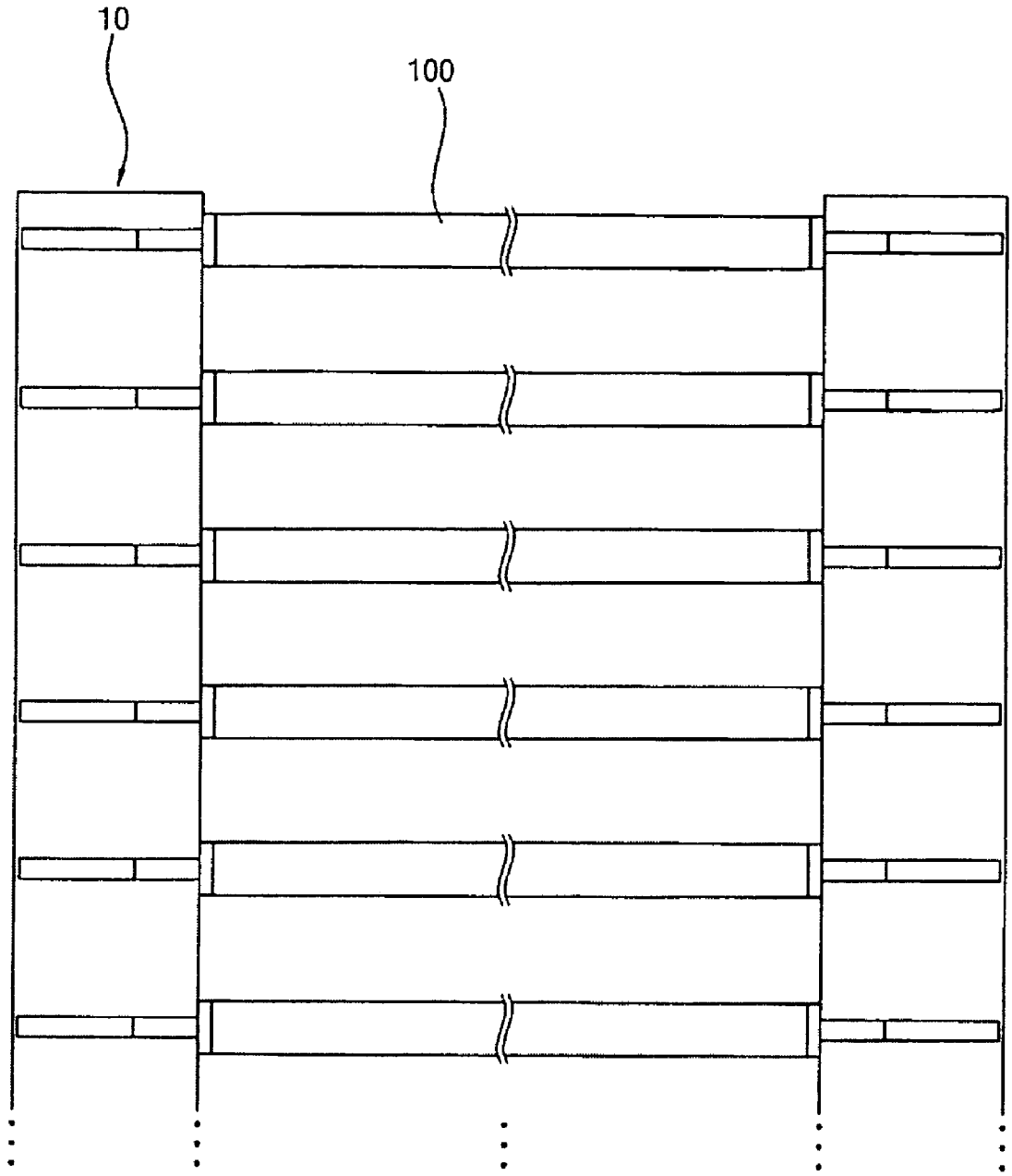
FIG. 18 is a plan view illustrating a backlight assembly in accordance with an embodiment of the present invention.
Figure 19:
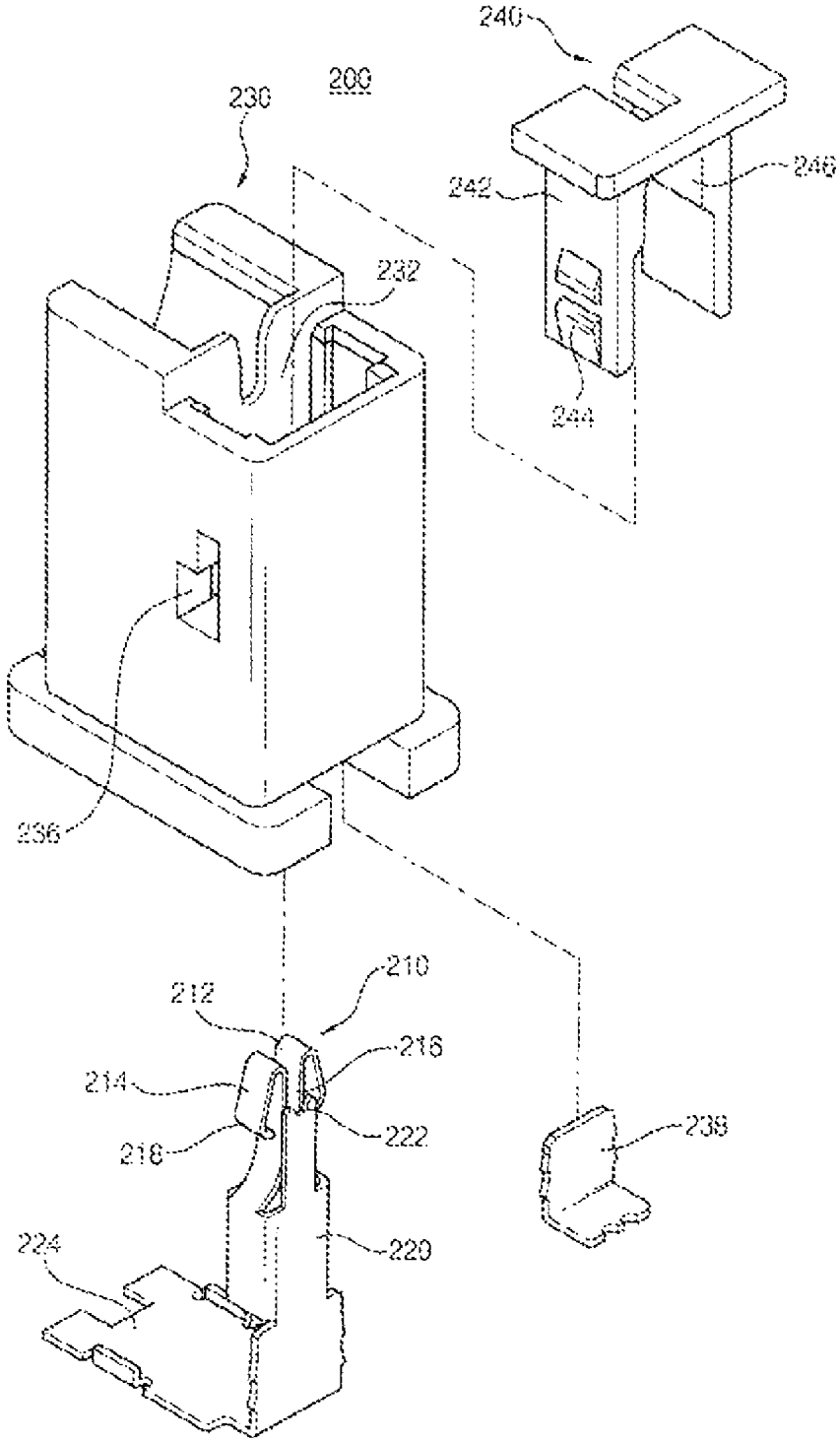
FIG. 19 is an exploded perspective view illustrating a conventional lamp holding unit of a related art.

FIG. 18 is a plan view illustrating a backlight assembly in accordance with an embodiment of the present invention.

Referring to FIG. 18, the lamp holding unit 10 is combined with a plurality of fluorescent lamps 10 to form the backlight assembly.

According to the present invention, a lamp holding unit is securely combined with a lamp so that an electrical connection between the lamp holding unit and a lead line of the lamp is stabilized. Thus, noise or spark caused by mal-connection is prevented.

In addition, a plurality of fluorescent lamps used for a liquid crystal display (LCD) device may be easily assembled through simplified processes.

This invention has been described with reference to the example embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A lamp holding unit comprising:

a coupling terminal including a coupling plate extended in a direction crossing a longitudinal direction of a lamp, the coupling plate having a cutout portion to receive a lead line of the lamp so that the cutout portion of the coupling plate making contact with the lead line; and a main body coupled with the coupling terminal and guiding the lamp;

the coupling terminal further comprises two horizontal plates spaced apart from each other and extended in the longitudinal direction;

two coupling plates extended from the horizontal plates, respectively; and a connecting plate that connects upper surfaces of the coupling plates, a slit being formed through the connecting plate to guide the lead line.

2. The lamp holding unit of claim 1, further comprising a securing part connected to the main body to press a side of the coupling terminal, so that the lead line is securely combined with the coupling terminal.

3. The lamp holding unit of claim 1, wherein the coupling plates and the connecting plate form a U-shape when viewed from a side of the lamp holding unit.

4. The lamp holding unit of claim 1, wherein a cutting slit is formed through the coupling plate under the lead line.

5. A lamp holding unit comprising:

a coupling terminal including a coupling plate extended in a direction crossing a longitudinal direction of a lamp, the coupling plate having a cutout portion to receive a lead line of the lamp so that the coupling plate making contact with the lead line;

a main body coupled with the coupling terminal and guiding the lamp; and a securing part connected to the main body, so that the lead line is securely combined with the coupling terminal;

a connecting plate connects a plurality of the coupling plates;

wherein the connecting plate connects the upper surfaces of the coupling plates, and a slit is formed through the connecting plate to guide the lead line.

6. The lamp holding unit of claim 5, wherein the securing part presses the lead line from an upper portion of the cutout portion.

7. The lamp holding unit of claim 5, wherein the securing part presses a side of the coupling terminal.

8. The lamp holding unit of claim 5, wherein the coupling plate includes a compressing portion that has a stepwise shape.

9. A lamp holding unit comprising:

a coupling terminal including:

a plurality of coupling plates extended in a direction crossing a longitudinal direction of a lamp, each of the coupling plates having a cutout portion to receive a lead line of the lamp so that the cutout portions of the coupling plates making contact with the lead line; and a connecting plate that connects the coupling plates, the coupling plates and the connecting plate forming a U-shape when viewed from a side of the lamp holding unit; and a main body coupled with the coupling terminal and guiding the lamp;

the connecting plate connects upper surfaces of the coupling plates, and a slit is formed through the connecting plate to guide the lead line.

10. The lamp holding unit of claim 9, wherein the coupling terminal further comprises a plurality of horizontal plates connected to the coupling plates, respectively.

* * * * *